US007000502B2

(12) United States Patent
Belik

(10) Patent No.: US 7,000,502 B2
(45) Date of Patent: Feb. 21, 2006

(54) DRILLPIPE SPINNER

(75) Inventor: Jaroslav Belik, Pearland, TX (US)

(73) Assignee: National-Ollwell, Houston, TX (US)

( * ) Notice: Subject to any disclaimer, the term of this patent is extended or adjusted under 35 U.S.C. 154(b) by 0 days.

(21) Appl. No.: 10/932,494

(22) Filed: Sep. 2, 2004

(65) Prior Publication Data

US 2005/0056122 A1 Mar. 17, 2005

Related U.S. Application Data

(60) Provisional application No. 60/500,487, filed on Sep. 5, 2003.

(51) Int. Cl.
*B25B 17/00* (2006.01)

(52) U.S. Cl. ..... 81/57.2; 81/57.16; 81/57.24; 81/57.34

(58) Field of Classification Search .... 81/57.15–57.17, 81/57.2, 57.22, 57.34; 166/77.51, 78.1, 85.1
See application file for complete search history.

(56) References Cited

U.S. PATENT DOCUMENTS

| | | | | |
|---|---|---|---|---|
| 3,392,609 A | | 7/1968 | Bartos | 81/57 |
| 3,892,140 A | * | 7/1975 | Fox et al. | 474/121 |
| 3,892,148 A | | 7/1975 | Wiley | 81/57.18 |
| 4,221,269 A | * | 9/1980 | Hudson | 173/222 |
| 4,381,685 A | | 5/1983 | Brooks | 81/57.2 |
| 4,425,827 A | * | 1/1984 | Wells | 81/57.19 |
| 4,446,761 A | * | 5/1984 | Boyadjieff et al. | 81/57.19 |
| 4,603,464 A | | 8/1986 | Smith, Jr. et al. | 29/428 |
| 4,694,712 A | | 9/1987 | Doss | 81/57.17 |
| 4,774,861 A | | 10/1988 | Hamilton et al. | 81/57.33 |
| 4,895,056 A | | 1/1990 | Schulze-Beckinghausen | 81/57.17 |
| 5,660,087 A | * | 8/1997 | Rae | 81/57.2 |
| 6,065,372 A | | 5/2000 | Rauch | 81/57.15 |
| 6,253,845 B1 | * | 7/2001 | Belik | 166/77.51 |
| 6,505,531 B1 | * | 1/2003 | Stogner | 81/57.16 |
| 2003/0164071 A1 | * | 9/2003 | Moe et al. | 81/57.2 |
| 2004/0103515 A1 | | 6/2004 | Penman | 29/426.5 |
| 2005/0076744 A1 | * | 4/2005 | Pietras et al. | 81/57.16 |

FOREIGN PATENT DOCUMENTS

| | | |
|---|---|---|
| GB | 2387186 | 8/2003 |
| WO | WO 01/81047 | 11/2001 |

* cited by examiner

*Primary Examiner*—David B. Thomas
(74) *Attorney, Agent, or Firm*—Howrey LLP

(57) ABSTRACT

The invention relates to an improved drill pipe spinner. The improved spinner may be used as a stand-alone piece of pipe handling equipment or may be used in an Iron Roughneck. The spinner comprises a pair of clamping arms that are movable between an open position and a closed position, wherein in the closed position, the arms will clamp about a pipe to be made up or broken out and in the open position, the spinner may be moved away from or towards the pipe. The arms are preferably moved between the open and closed positions by a hydraulically actuated clamping cylinder. Attached to the distal ends of each arm is a roller bracket. The roller brackets are preferably attached to the clamping arms by a roller bracket pin. Each roller bracket includes a pair of drive roller assemblies, which together form the spinning unit. Each drive roller assembly preferably comprises a pair of drive rollers, with each roller rotated by a pair of hydraulic motors. If the rollers of the spinner have to be repaired, serviced or replaced, the arm brackets are easily removed by simply pulling the roller bracket pin and removing the roller bracket. A new roller bracket may then be picked up, aligned with and pinned to the arm by reinserting the roller bracket pin. The spinning unit can easily be removed and replaced on the rig floor by changing out the roller bracket.

31 Claims, 13 Drawing Sheets

DRILLPIPE SPINNER

FIELD OF THE INVENTION

The present application claims priority to U.S. Provisional Patent Application Ser. No. 60/500,487 filed Sep. 5, 2003, the contents of which are incorporated herein by reference.

The present invention relates to a drilling device particularly useful in the oil and gas industry. In particular, the invention relates to an improved drillpipe spinner device that is used in the make-up and break-out of drillpipe, either as a stand alone tool or as part of an Iron Roughneck, which has easily removable roller brackets for quick replacement of the spinning unit.

BACKGROUND OF THE INVENTION

In the oil and gas industry, a drillstring is used by a drilling rig to drill a wellbore. The drillstring is typically composed of drillpipe and the bottomhole assembly, the latter including the drill bit, drill collars and other drilling related tools. An automated apparatus generally known as an "Iron Roughneck," may be utilized to make-up and break-out threaded joints of drill pipe in a drill string. Iron Roughnecks have been used in the drilling industry for several years and are commercially available from a number of suppliers. For example, the model IR30-80 is marketed by National Oilwell in Houston, Tex. An Iron Roughneck generally comprises a two-piece wrench unit and a spinner unit. The spinner rotates a joint of drill pipe relative to a second joint to either screw the pin end of the tool joint of the first joint of drill pipe into the box end of the tool joint of the second joint or to unscrew the tool joints of the two joints of drill pipe. The wrench unit provides the torque necessary to make-up or break-out the connection. The bottom wrench, which serves as a back-up wrench, grasps the tool joint of the drill pipe suspended in the rotary table or mousehole. The upper wrench grasps the tool joint of the pipe suspended from the derrick and applies either the final make-up, or the initial break-out torque to the connection.

Drill pipe spinners may also be used as a stand-alone piece of pipe handling equipment. As with the Iron Roughneck version, the spinner rotates a joint of drill pipe relative to another joint of drill pipe during the make-up or break-out of the connection between the two joints. Separate pipe wrenches may be employed to apply the final make-up torque or initial break-out torque to the connection.

Regardless of the configuration in which the drill pipe spinner is used, the spinning unit of the apparatus, which typically comprises the drive wheels and hydraulic motors among other things, must be repaired or replaced from time to time. This typically means that the entire spinner is replaced due to the complexity of the spinning unit and the time necessary to repair, service or replace the same. Typical spinners are removed from the rig floor and sent back to a shop to repair, replace or service the spinning unit where there is less congestion and less time pressure than on the rig floor. This is typically more efficient both in rig time and money than to attempt to repair or replace the units on the rig floor. Thus, the standard practice is to remove the entire drill pipe spinner apparatus from the critical path of drilling activities on the rig floor. However, the replacement of the entire spinner with another spinner apparatus is still time consuming as well as inefficient in the number of spinners that must be maintained in inventory at any given point in time, either at the rig site, back at the service facility, or in transport there between.

Thus, it would be desirable to have a system that is lightweight, compact in size, and easily installed on the rig floor for the replacement, repair or servicing of the spinning unit for a drill pipe spinner. The present invention is directed to such a system.

SUMMARY OF THE INVENTION

The invention relates to an improved drill pipe spinner. The improved spinner may be used as a stand-alone piece of pipe handling equipment or may be used in an Iron Roughneck. The spinner comprises a pair of clamping arms, which preferably are connected together at one end by and pivot about an arm pin. The clamping arms are movable between an open position and a closed position, wherein in the closed position, the arms will clamp about a pipe to be made up or broken out and in the open position, the spinner may be moved away from or towards the pipe. The arms are preferably moved between the open and closed positions by a hydraulically actuated clamping cylinder. Attached to the distal ends of each arm is a roller bracket. The roller brackets are preferably attached to the clamping arms by a roller bracket pin, which extends through a pinhole in both the roller bracket and arm. Each roller bracket includes a pair of drive roller assemblies and bearings. Each drive rollers assembly preferably comprises a pair of drive rollers, with each roller rotated by a pair of hydraulic motors. Alternatively, each roller may have a single drive motor on one side of the roller and a bearing supported on the other side of the roller.

If the rollers of the spinner have to be repaired, serviced or replaced, the arm brackets are easily removed by simply pulling the roller bracket pin and removing the roller bracket. A hook may be used to attach a line to help remove the roller bracket from the spinner. A new roller bracket may then be picked up, aligned with and pinned to the arm by reinserting the roller bracket pin. Unlike prior art drill pipe spinners, the rollers can easily be removed and replaced on the rig floor by changing out the roller bracket. The new roller, with the new roller bracket, can be added in a matter of minutes to the spinner. The old roller bracket can then be taken to the rig shop for repair, service, or replacement of the roller(s) and/or hydraulic motor(s). The easily exchangeable arm brackets minimize the downtime on the rig when the spinner unit needs to be repaired or replaced, while also minimizing the needed inventory of drill pipe spinners.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
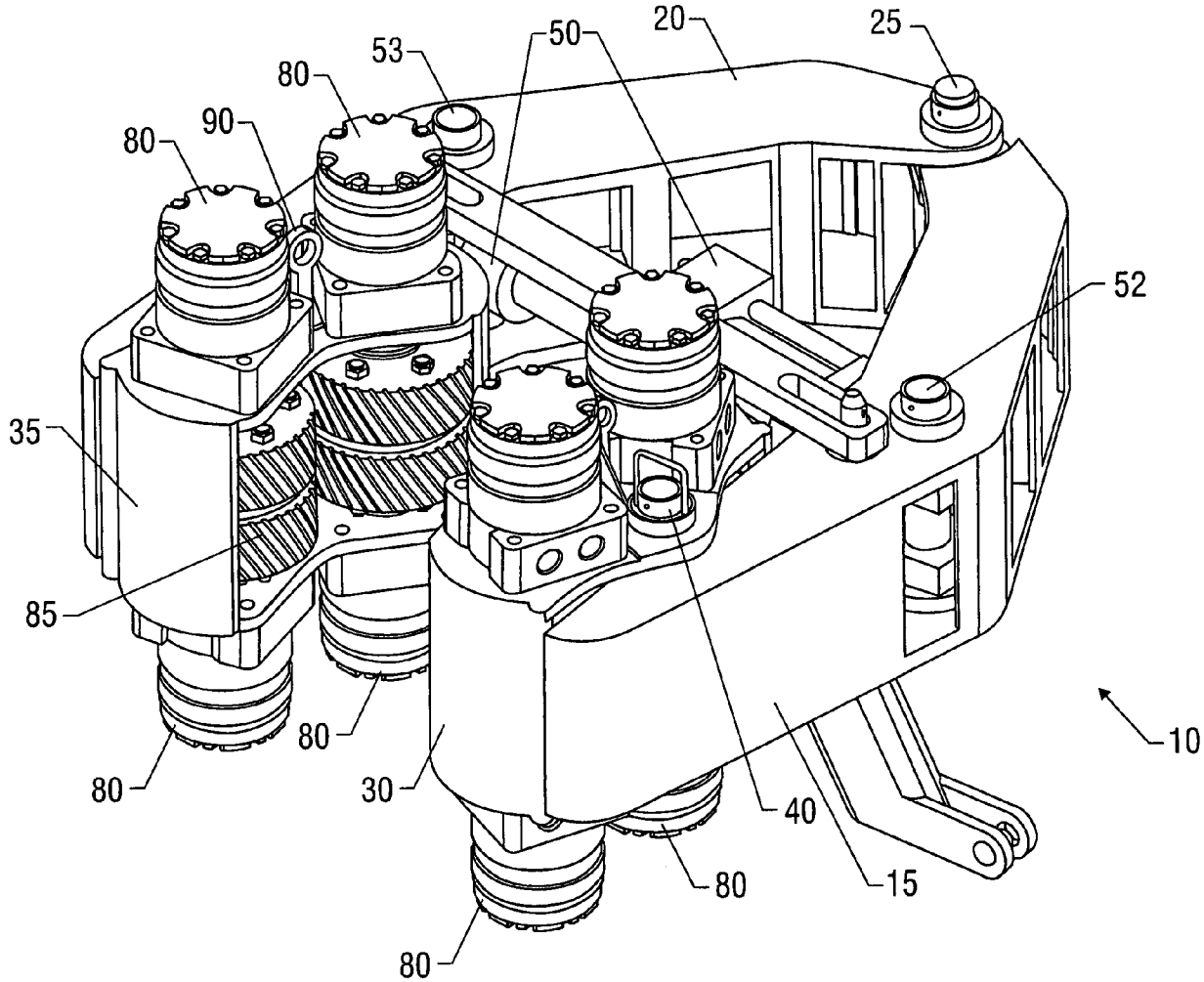
FIG. 1 illustrates one embodiment of the improved drill pipe spinner.

FIG. 1 illustrates a preferred embodiment of the improved drill pipe spinner 10 of the present invention. The drill pipe spinner includes a pair of clamping arms 15 and 20, which are pivotably connected together at one end by arm pin 25. Arms 15 and 20 are movable between an open position and a closed position, wherein the closed position, the arms will clamp about a pipe to be made up or broken out and in the open position, the spinner may be moved away from or towards the pipe. The arms are preferably moved between the open and closed positions by a hydraulically actuated clamping cylinder 50. Cylinder 50 extends between arms 15 and 20 and is connected to the arms by cylinder pins 52 and 53.

Figure 2:
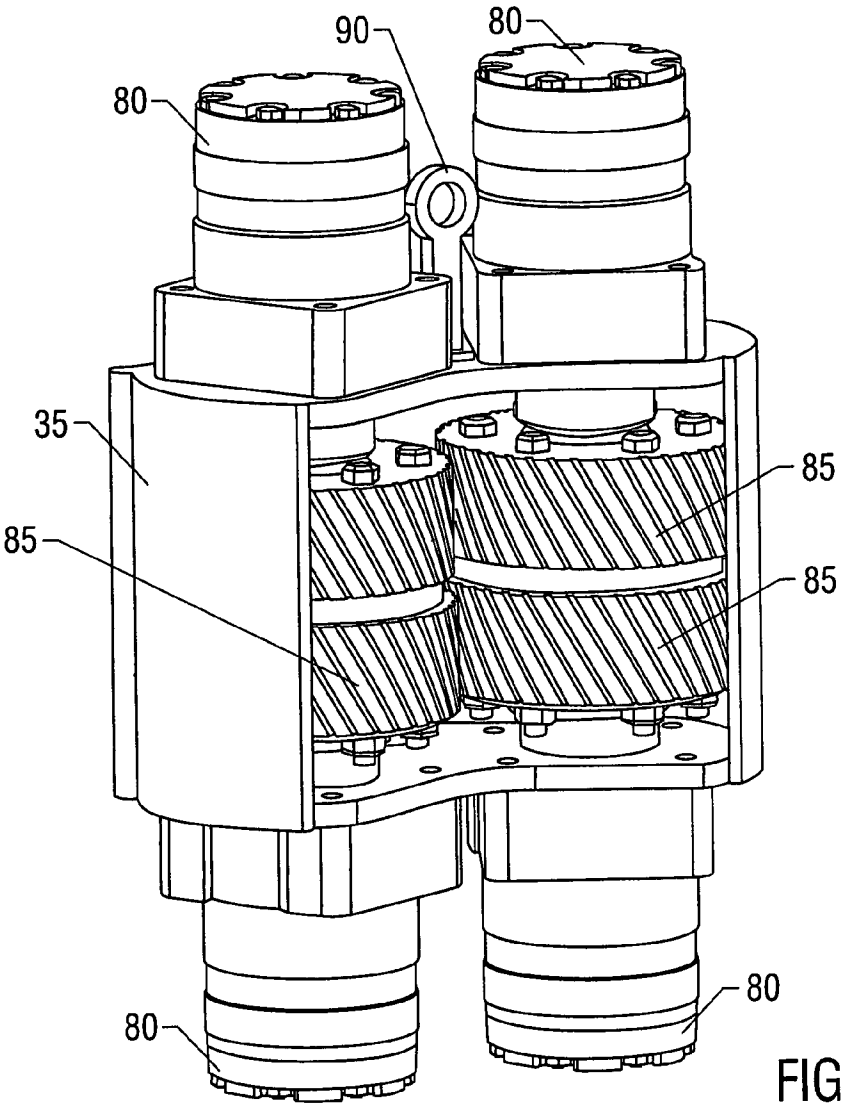
FIG. 2 illustrates a roller bracket for the drill pipe spinner of FIG. 1.
Figure 3A:
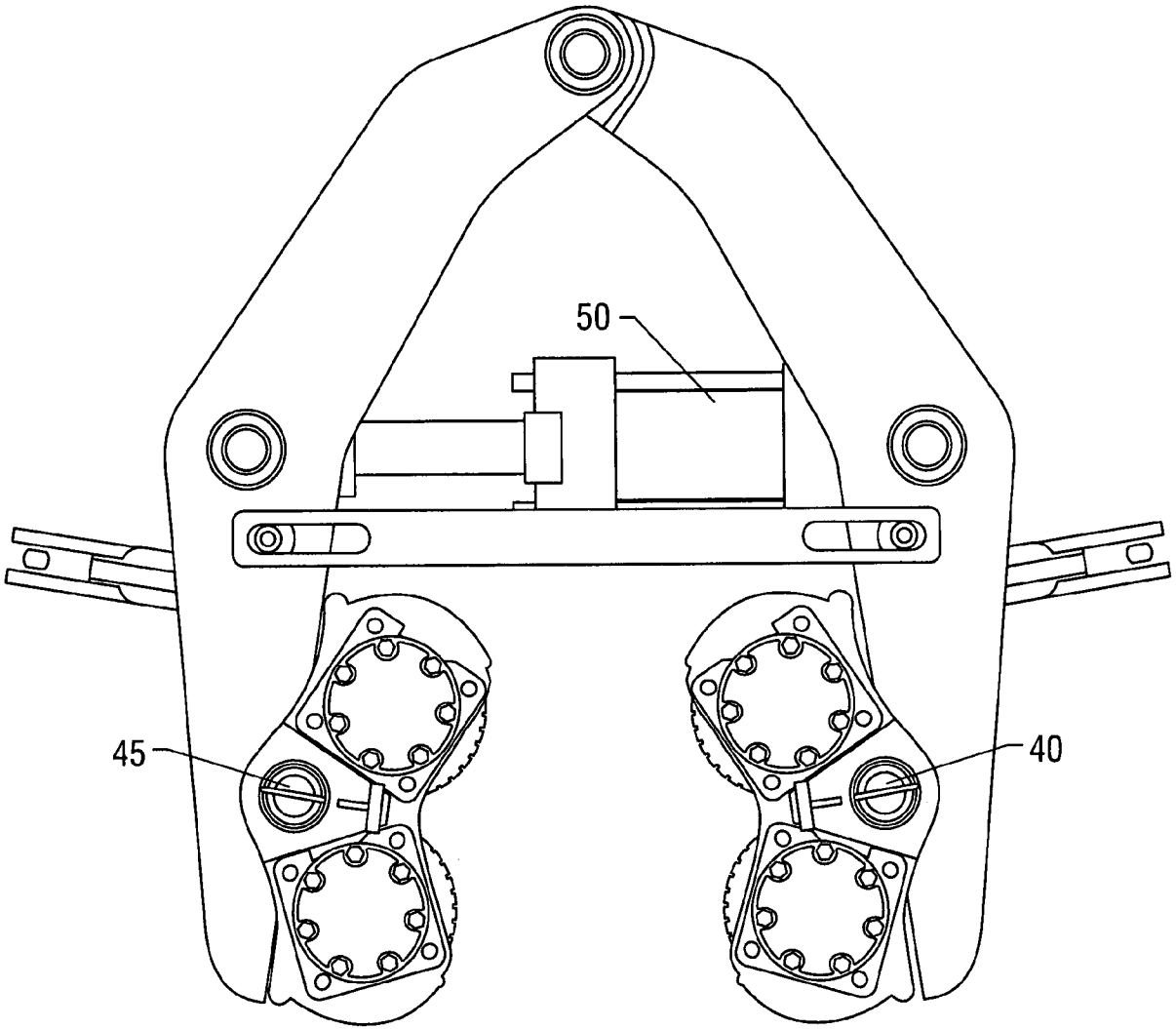
FIGS. 3A and 3B is a top view of one embodiment of the drill pipe spinner illustrating the open and closed positions, respectively.
Figure 3B:
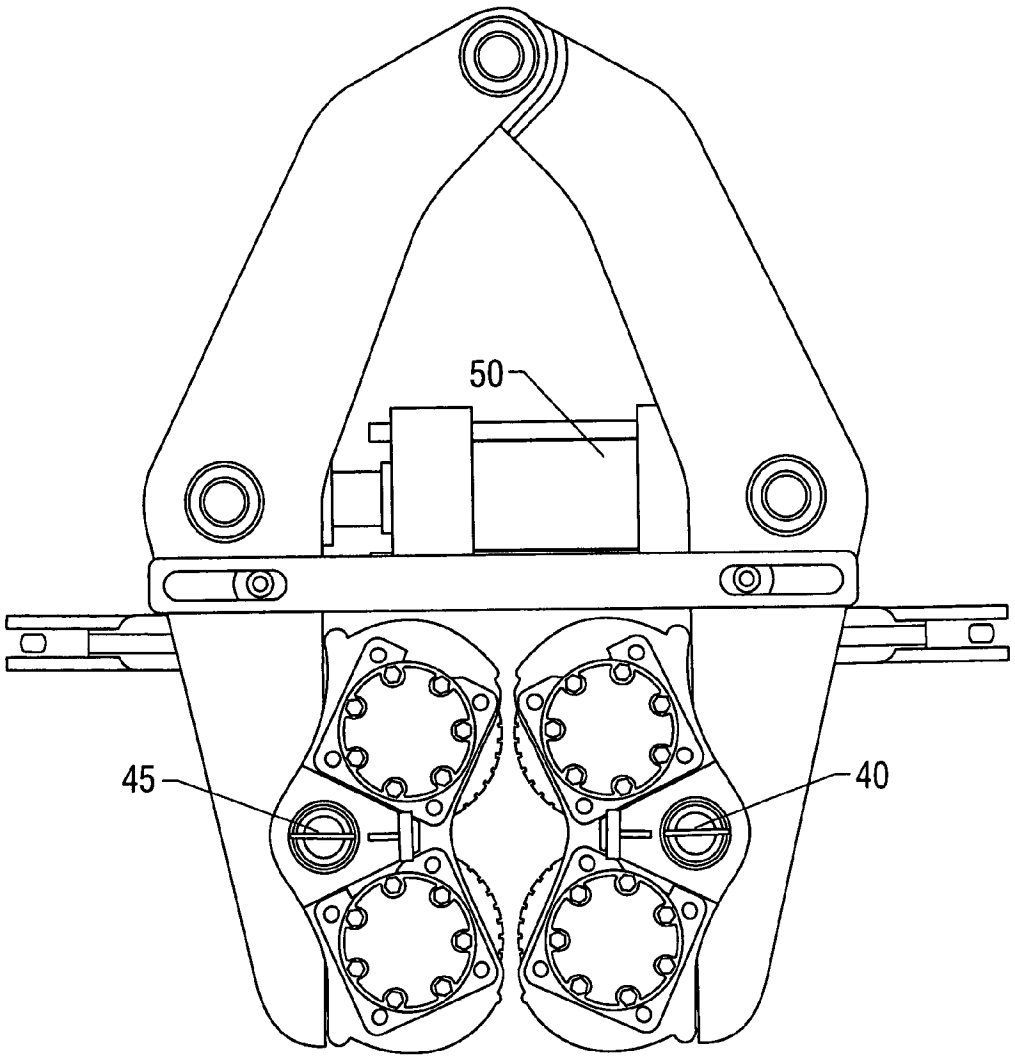

Attached to the distal ends of arms 15 and 20 are roller brackets 30 and 35, respectively. Roller bracket 30 is attached to arm 15 by roller bracket pin 40, which extends through pinholes in both bracket 30 and arm 15. Roller bracket 35 is similarly connected to arm 20 by roller bracket pin 45 (not shown in FIG. 1). Each roller bracket, as more clearly shown in FIG. 2, include a pair of drive roller assemblies. Each drive rollers assembly comprises one or more drive rollers 85 that are rotated by a pair of hydraulic motors 80. Alternatively, each roller may be rotated by a single motor and supported on the other side of roller by a bearing (not shown). In a preferred embodiment, the roller assembly includes a pair of rollers 85. Each roller may be made of steel, aluminum, polyurethane or other suitable friction material for applying a rotational force to the outer diameter of drill pipe. Preferably, bearing-less rollers are used with drive wheel motors having strong bearings inside the motor. Such motors are commercially available from various sources in the industry, such as the model RE motor from White Motors. Only the shaft from the motor extends through the rollers since the rollers contain no bearings. Since the rollers do not have bearings, the spinner does not have to be lubricated. As shown in FIG. 2, the two rollers are bolted together to a roller body. The shaft of each of the motors extends into a mating cavity in the body. In a preferred embodiment, the spinner includes the rollers described in U.S. Pat. No. 6,253,845, which is incorporated herein by reference.

The rollers 85 in FIGS. 1 and 2 must be synchronized to properly rotate the drill pipe. This may be accomplished by hydraulically connecting the upper four motors in series and hydraulically connecting the lower four motors in parallel. Alternatively, the upper four motors may be hydraulically connected in parallel and the lower motors in series. FIG. 7 illustrates schematically a hydraulic layout for synchronizing the motors of the drill pipe spinner so that rollers 85 rotate at substantially the same speed. The hydraulic lines for the drill pipe spinner are not illustrated in FIGS. 1–6 for clarity purposes but the use of such hydraulic lines are well within the knowledge of one skilled in the art of pipe handling equipment.

Figure 4:
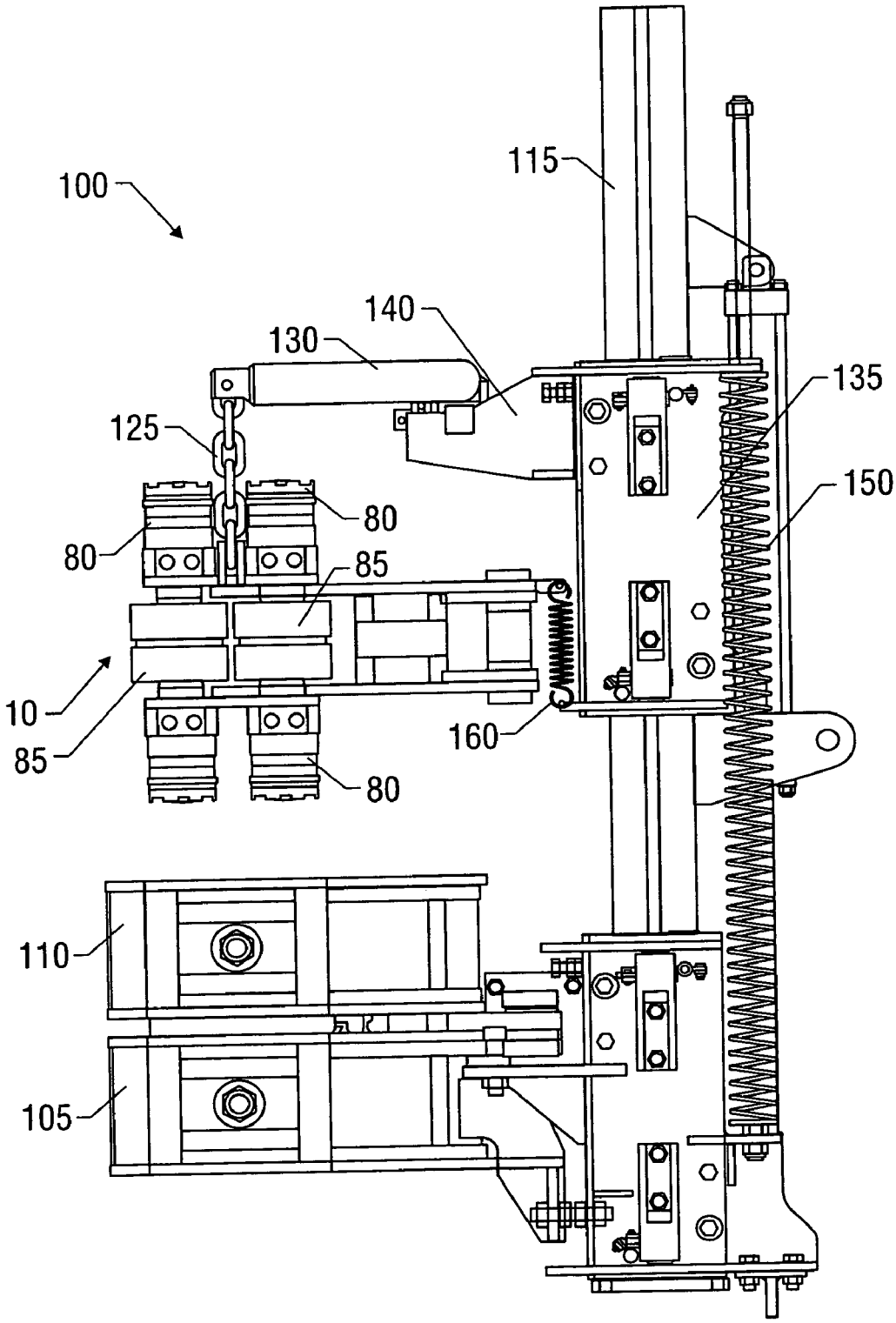
FIG. 4 is a side view of the drill pipe spinner as part of an Iron Roughneck.

FIG. 4 illustrates an embodiment of the improved drill pipe spinner that is part of an Iron Roughneck. Iron Roughneck 100 comprises lower pipe wrench 105, upper wrench 110, and drill pipe spinner 10. The upper and lower wrenches and drill pipe spinner 10 are attached as a unit about column 115. Spinner 10 may be suspended by chain 125 from spinner post 130. Spinner post 130 is connected to guide 135 by bracket 140. Iron Roughneck 100 may include one or more springs 150 that allows the spinner and guide 135 to move with the drill pipe as the drill pipe connection is made up or broken out. Alternatively, one or more hydraulic cylinders (not shown) may be used instead of spring(s) 150 to compensate for the movement of the drill pipe during make up or break out. One or more smaller springs 160 may be used to help balance the spinner in the horizontal position.

Figure 5A:
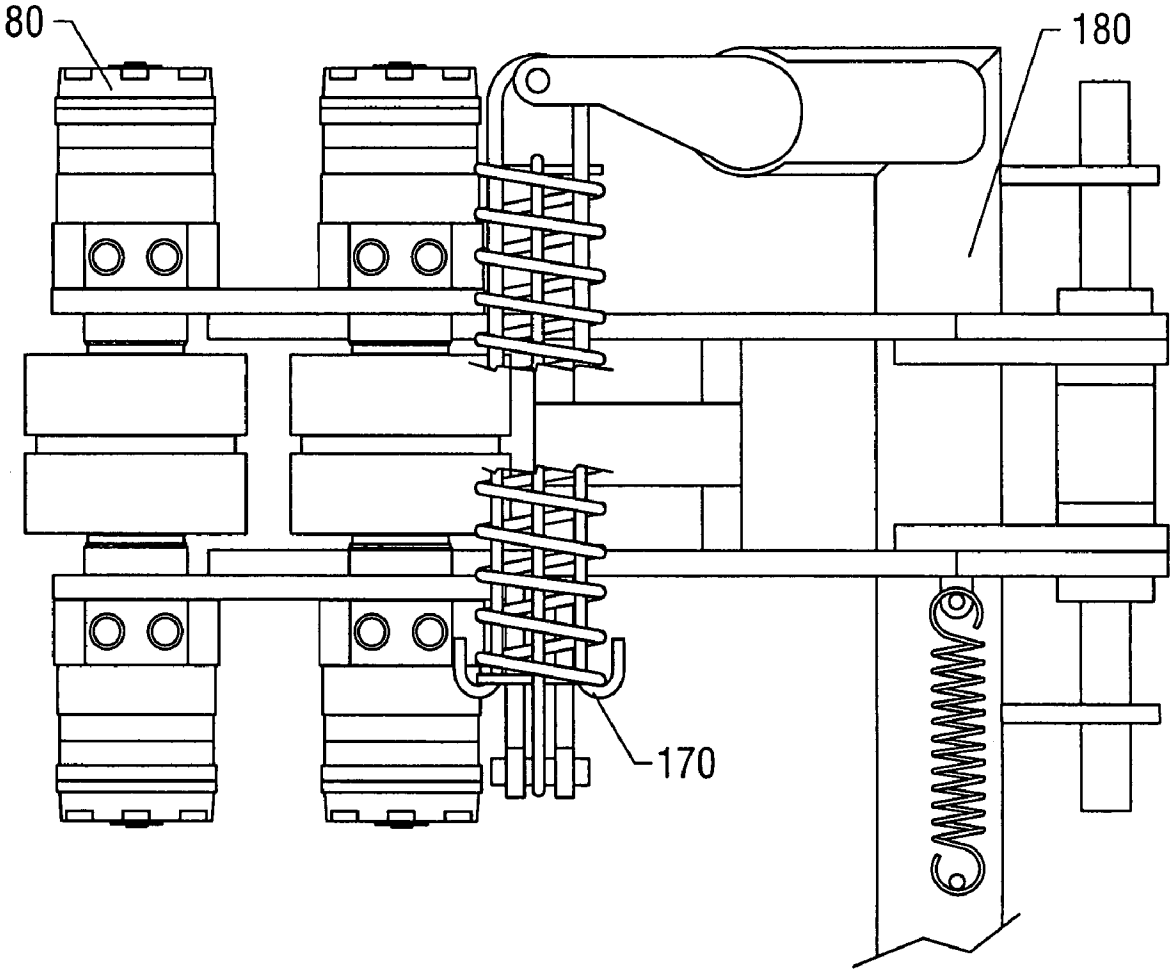
FIG. 5A is a side view of one embodiment of the drill pipe spinner for an Iron Roughneck.
Figure 5B:
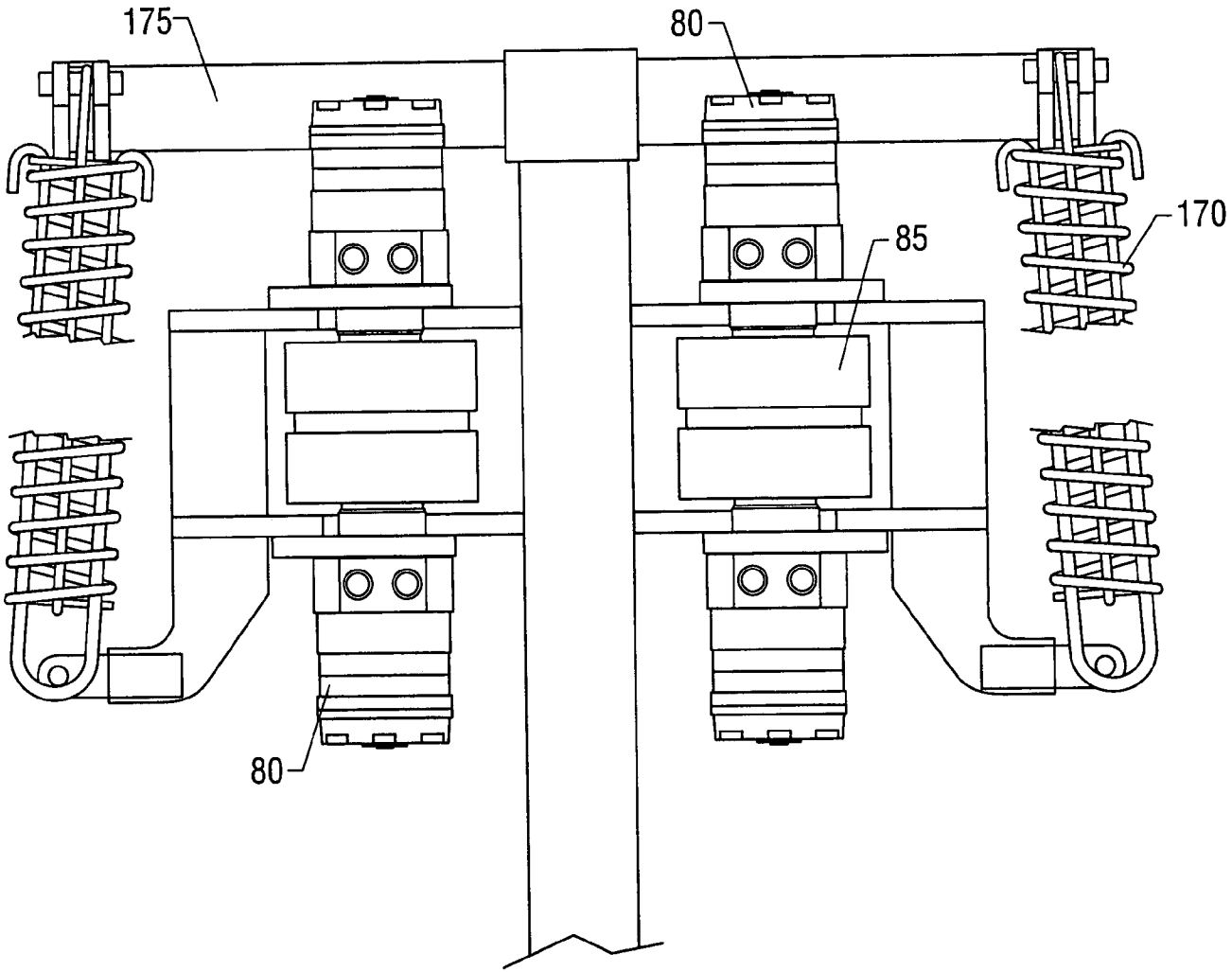
FIGS. 5B and 5C is a front view of the drill pipe spinner of FIG. 5A, illustrating the open and closed positions of the spinner.
Figure 5C:
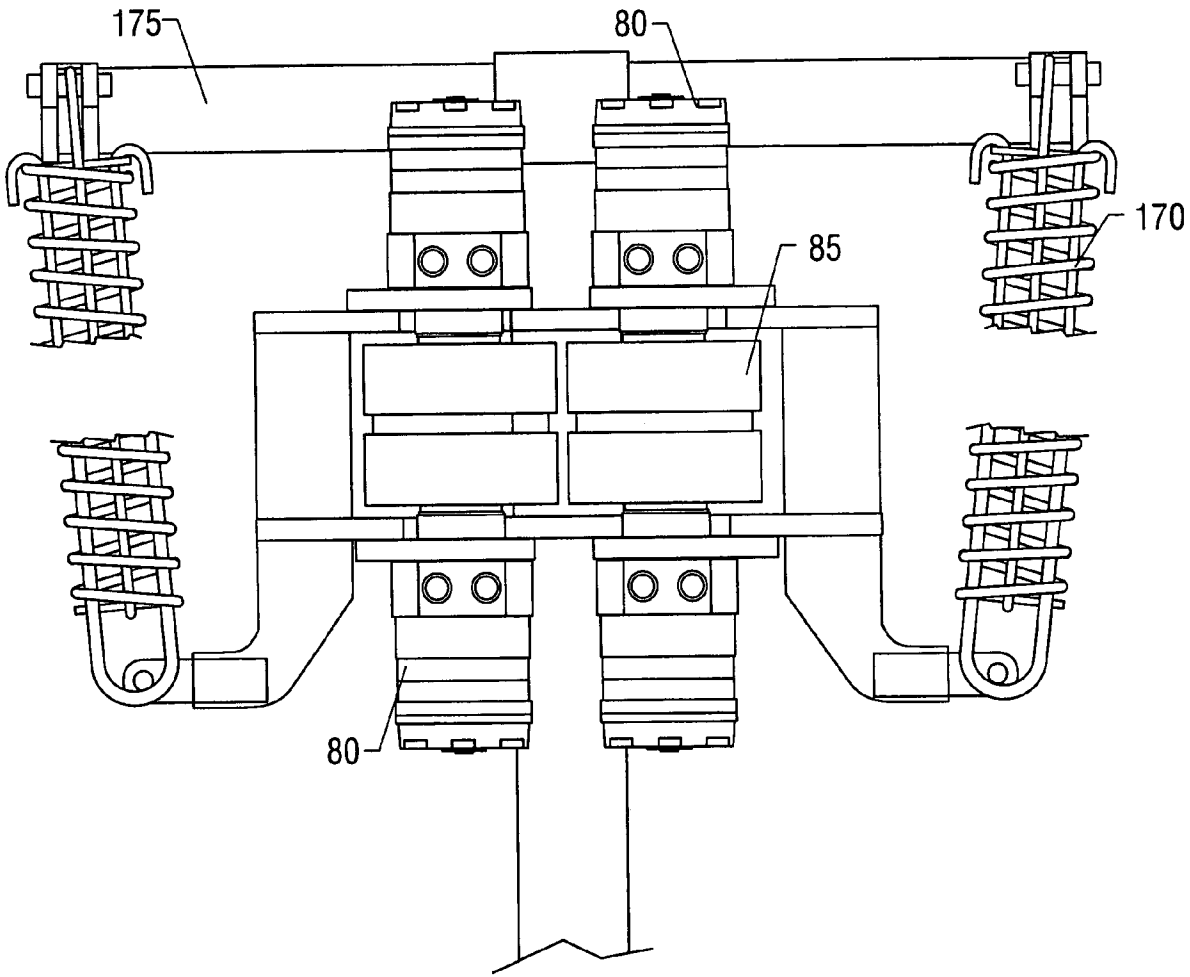

FIGS. 5A–5C illustrate another embodiment of the drill pipe spinner for an Iron Roughneck. FIG. 5B shows the spinner in the open position, while FIG. 5C shows the spinner in the closed position. Suspension springs 170 connect the spinner to post arms 175. Post arms 175 extend from spinner post 180. Springs 170 also help balance the spinner in the horizontal position.

Figure 6A:
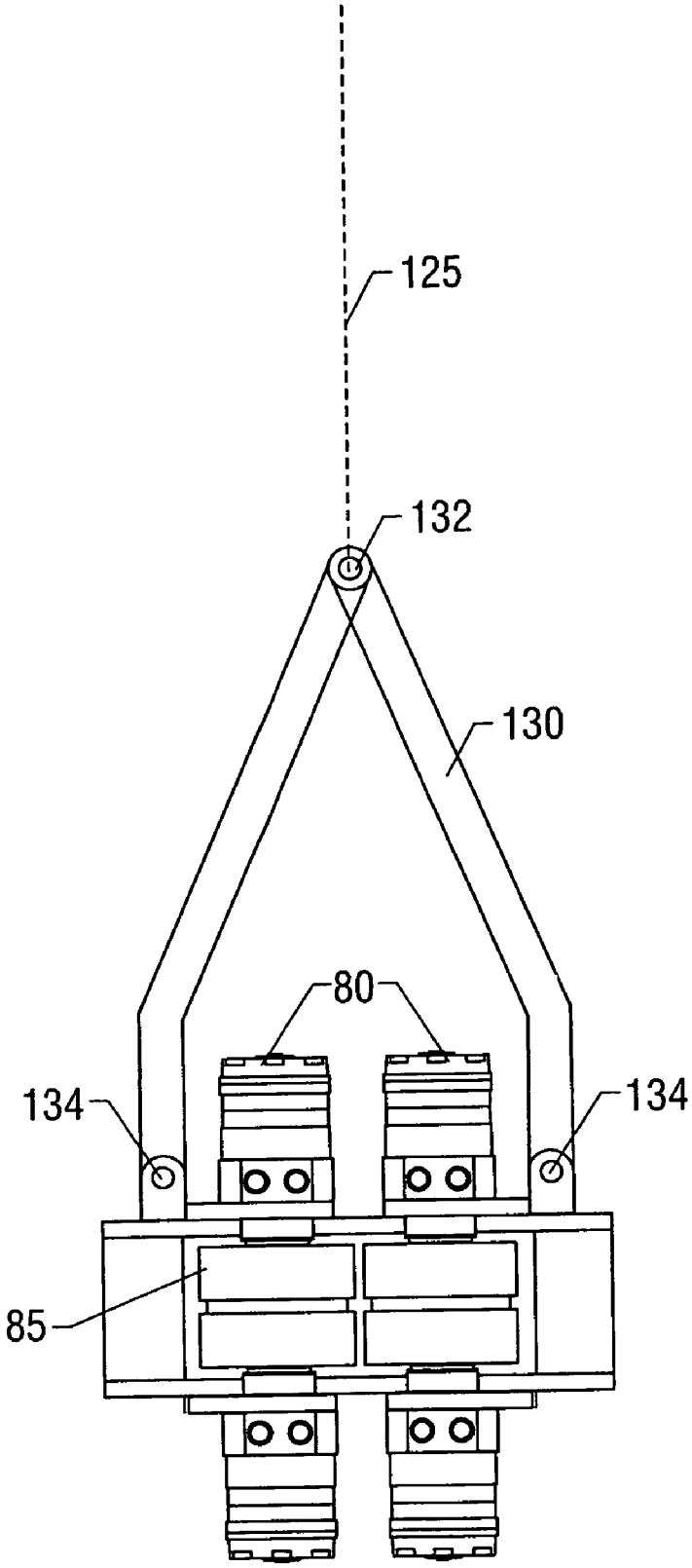
FIGS. 6A and 6B are front and side views of one embodiment of a stand-alone drill pipe spinner.
Figure 6B:
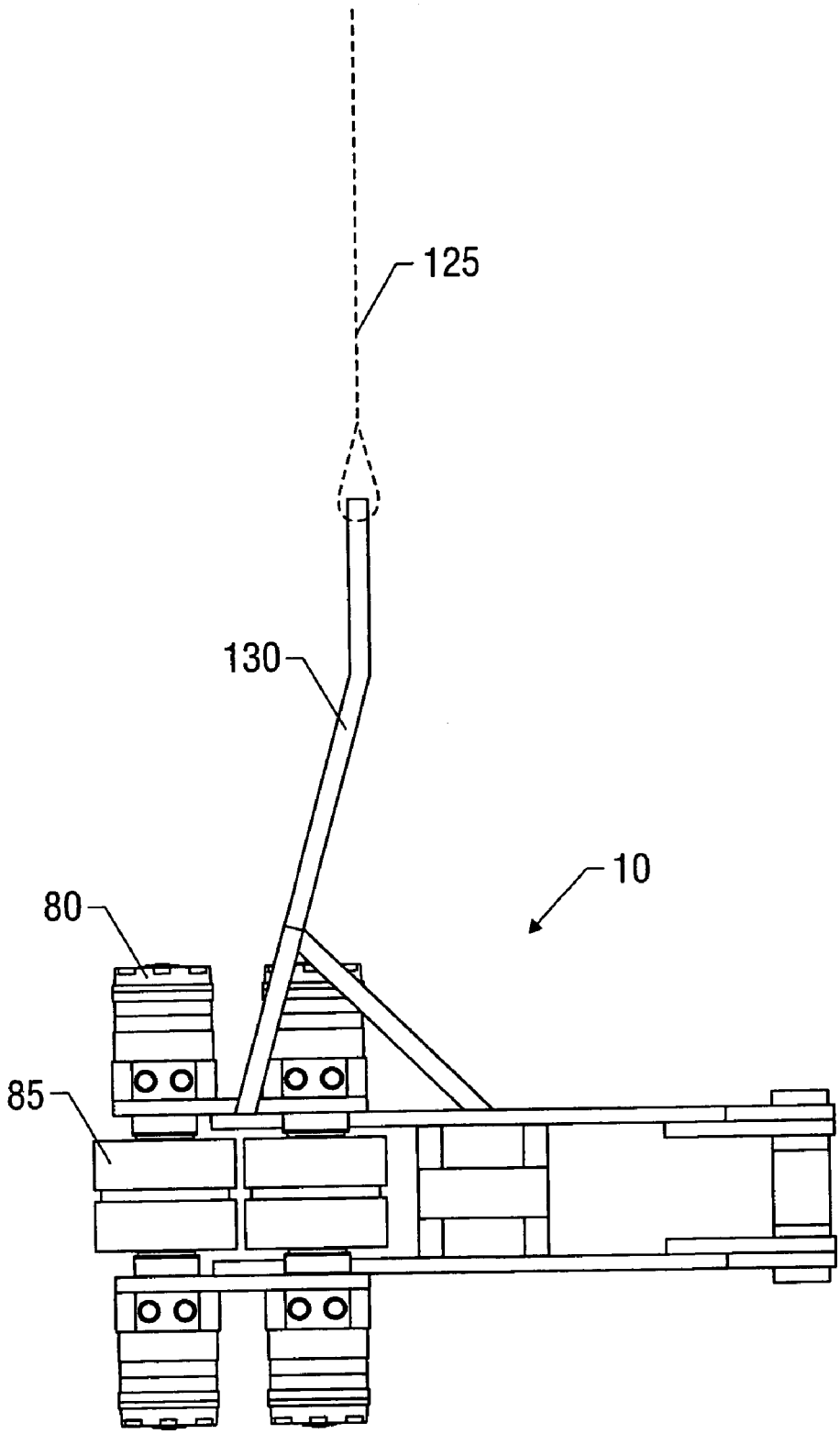
Figure 7:
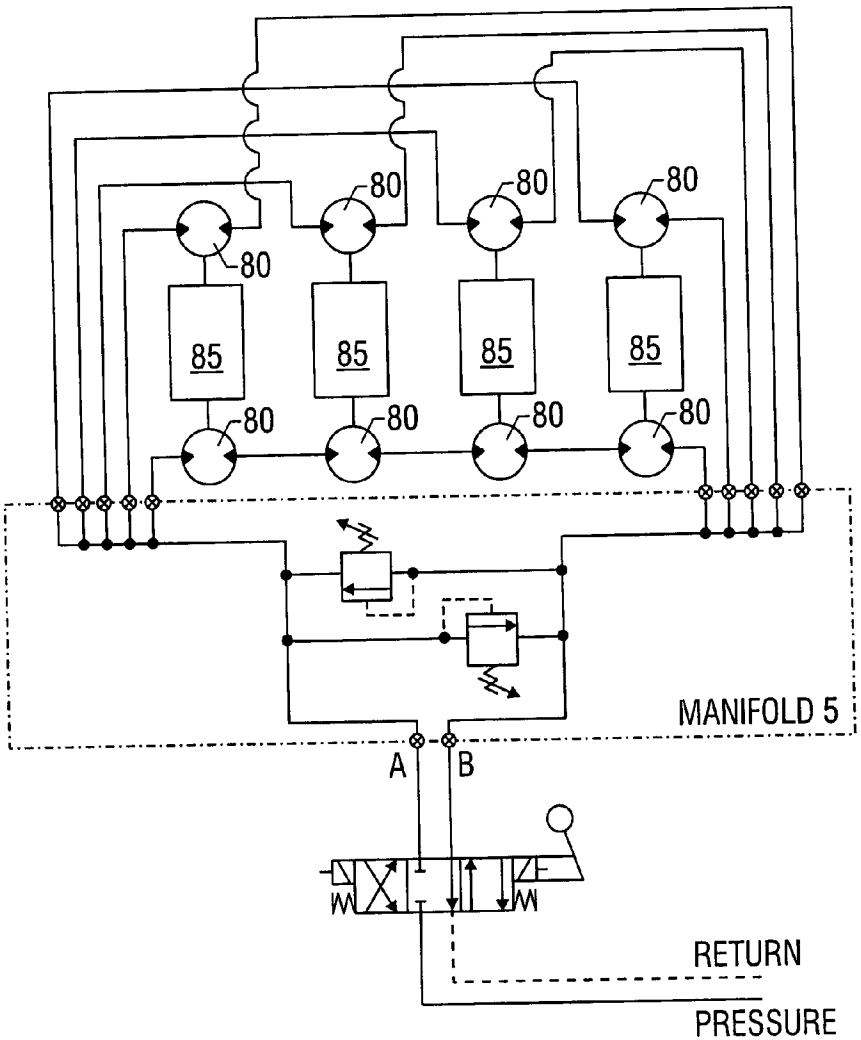
FIG. 7 illustrates schematically a hydraulic layout for synchronizing the motors of the drill pipe spinner.

FIG. 6 illustrates an embodiment of the drill pipe spinner that is used as a stand-alone spinning unit for making up and breaking out drill pipe. The spinner is suspended from the derrick by cable 125. Cable 125 may be attached to a counterweight at its other end to facilitate the handling of the spinner unit. A spring or cylinder (not shown) may be use above the spinning unit to allow the unit to travel with a joint of drill pipe as the pin end of that joint of pipe is being screwed into or out of the box end of another joint of drill pipe. The cable is attached to suspending arms 130 at pivot 132. The suspending arms are connected to the spinner at pivots 134. Pivots 132 and 134 allow suspending arms 130 to pivot as arms 15 and 20 are moved between the open and closed positions.

If the rollers and/or hydraulic drive motors of the spinner have to be repaired, serviced or replaced, the arm brackets are easily removed by simply pulling the roller bracket pin, 40 or 45, and removing the roller bracket. A hook 90 may be used to attach a line to help remove the roller bracket from the spinner. A new roller bracket may then be pinned to the arm by reinserting the roller bracket pin. Unlike prior art drill pipe spinners, the rollers can easily be removed and replaced on the rig floor by changing out the roller bracket. The new roller, with the new roller bracket, can be added in a matter of minutes to the spinner (e.g., in 30 minutes or less (preferably in 15 minutes or less)). The old roller bracket can then be taken to the rig shop for repair or replacement of the roller(s) and/or hydraulic motor(s). The easily exchangeable arm brackets minimize the downtime on the rig when the rollers on the spinner need to be replaced.

Figure 8A:
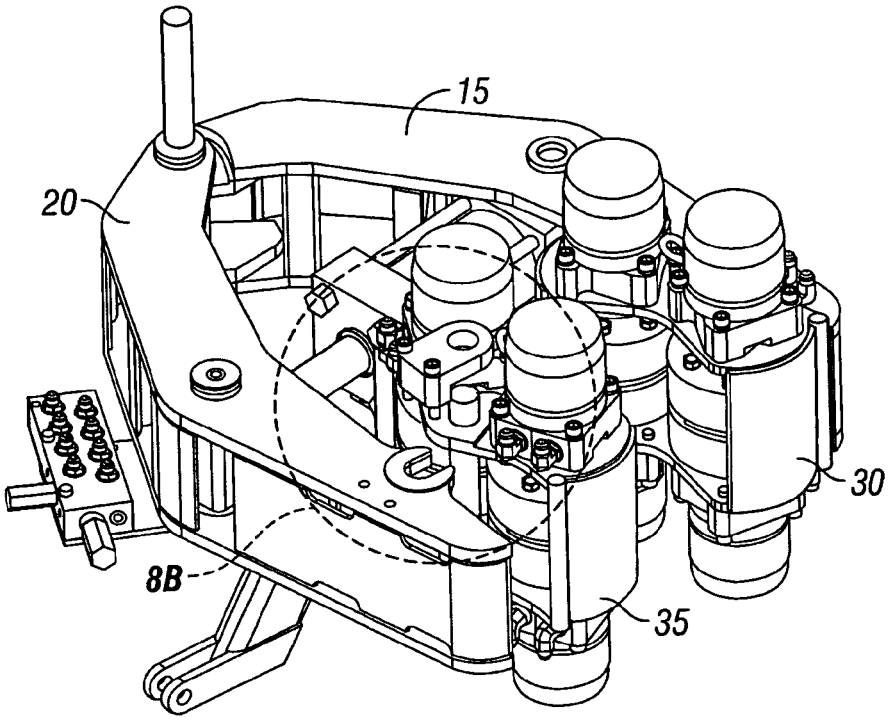
FIGS. 8A–8C illustrate an alternative means for connecting the roller brackets to the clamping arms of the drill pipe spinner.
Figure 8B:
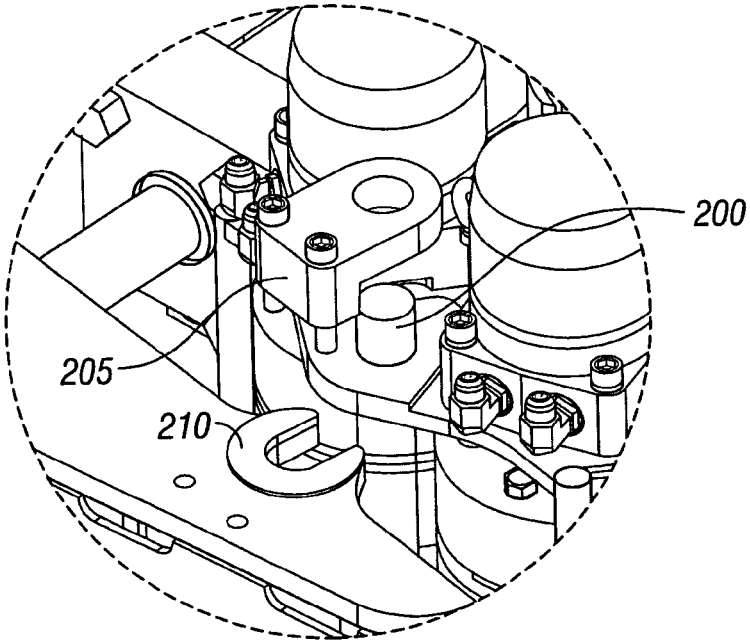
Figure 8C:
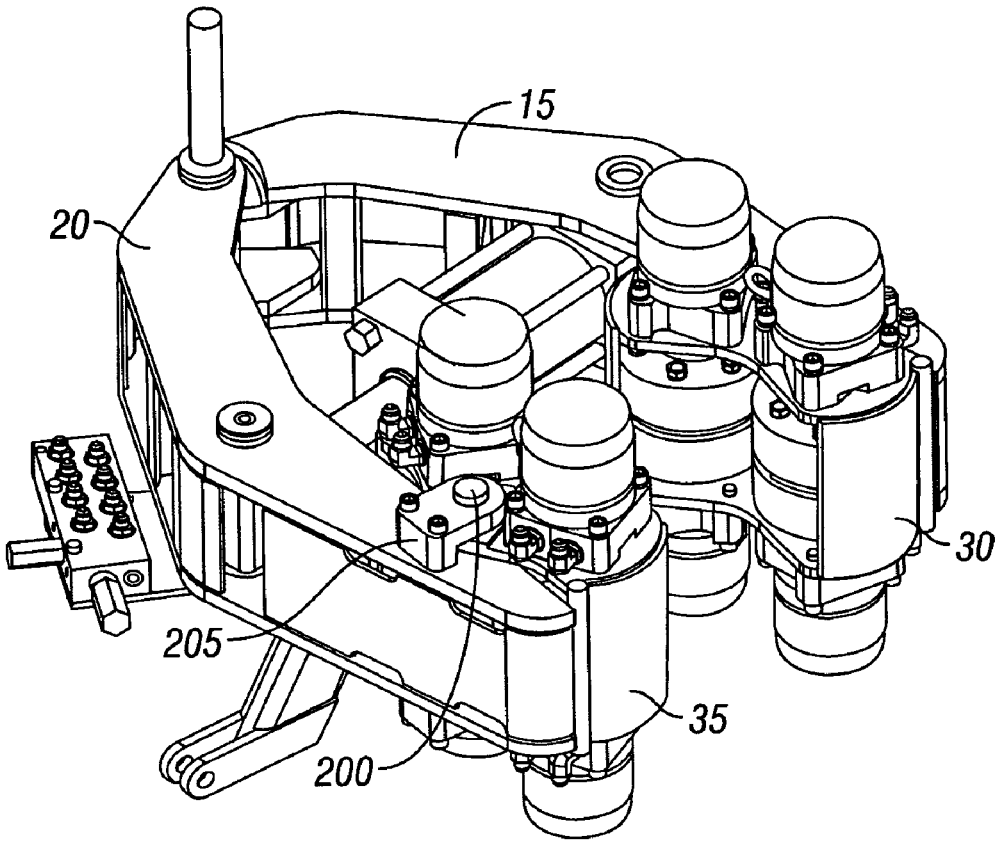

FIGS. 8A–8C show an alternative means for connecting the roller brackets to the clamping arm. Pin 200 extends through the support frame of the roller bracket. The roller bracket may be pivotably connected to the clamping area via end cap 205 and socket 210. More particularly, pin 200 may be mounted inside socket 210 and held there by cap 205. The upper end of pin 205 may extend into or through cap 205 (the latter illustrated in FIG. 8C). Cap 205 may be bolted to clamp arm 20 to secure pin 200, and hence roller bracket 35 to clamping arm 20. The lower end of pin 205 may extend into or through a lower cap (not shown) similar to cap 205 that is connected to the lower end of socket 210. Alternatively, the lower socket may have an integral cup or floor that pin 200 extends into. Once connected, roller bracket 35 may pivot about socket 210 so that the bracket may be closed about a drillpipe. Roller bracket 30 may be attached to clamping arm 15 in a similar fashion.

While the apparatuses and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A drillpipe spinner comprising:

a pair of clamping arms pivotably connected together at one end, the arms movable between an open position and a closed position;

a roller bracket attached to the other end of each arm, each roller bracket includes a pair of drive roller assemblies;

each roller bracket attached to the clamping arms by a pin member, wherein each roller bracket may be removed from the drillpipe spinner by removing only the pin member;

each drive roller assembly comprises one or more drive rollers, with each roller rotated by one or more motors; and wherein when the clamping arms are in the closed position, the drive rollers contact the outer diameter of a drill pipe and are operable to apply a rotational force to the drillpipe.

2. The drillpipe spinner of claim 1, wherein a hydraulically actuated cylinder moves the arms between the open and closed positions.

3. The drillpipe spinner of claim 1, wherein the pin extends through pinholes in the bracket and arm.

4. The drillpipe spinner of claim 1, wherein each roller assembly includes a pair of drive rollers.

5. The drillpipe spinner of claim 1, wherein each roller assembly includes one or more bearing-less rollers.

6. The drillpipe spinner of claim 5, wherein the shaft of each motor extends into a mating cavity of the one or more bearing-less rollers.

7. The drillpipe spinner of claim 1, wherein the pin extends through a socket in the clamping arm.

8. The drillpipe spinner of claim 7, wherein the pin is held in the socket by one or more end caps.

9. The drillpipe spinner of claim 1, wherein each drive roller is rotated by an upper motor and a lower motor.

10. The drillpipe spinner of claim 9, wherein the rollers are synchronized by hydraulically connecting the upper motors in series and hydraulically connecting the lower motors in parallel.

11. The drillpipe spinner of claim 9, wherein the rollers are synchronized by hydraulically connecting the upper motors in parallel and hydraulically connecting the lower motors in series.

12. The drill pipe spinner of claim 1, wherein the one or more motors comprises a hydraulic motor.

13. An iron roughneck comprising:

an upper wrenching unit;

a lower wrenching unit; and the drillpipe spinner of claim 1.

14. A drillpipe spinner comprising:

a pair of clamping arms pivotably connected together at one end by a single pin, the arms movable between an open position and a closed position;

a roller bracket attached to the other end of each arm by a removable pin, each roller bracket includes a pair of drive roller assemblies;

each drive roller assembly comprises one or more drive rollers, with each roller rotated by one or more motors;

wherein when the clamping arms are in the closed position, the drive rollers contact the outer diameter of the drill pipe and are operable to apply a rotational force to the drillpipe; and wherein each roller bracket may be removed from the drillpipe spinner by removal of only the pin.

15. The drillpipe spinner of claim 14, wherein a hydraulically actuated cylinder moves the arms between the open and closed positions.

16. The drillpipe spinner of claim 14, wherein the pin extends through pinholes in the bracket and arm.

17. The drillpipe spinner of claim 14, wherein each roller assembly includes a pair of drive rollers.

18. The drillpipe spinner of claim 14, wherein each roller assembly includes one or more bearing-less rollers.

19. The drillpipe spinner of claim 18, wherein the shaft of each motor extends into a mating cavity of the one or more bearing-less rollers.

20. The drillpipe spinner of claim 1 or 14 further comprising a pair of suspending arms wherein one end of a first suspending arm is pivotably connected to one of the clamping arms, one end of a second suspending arm is pivotably connected to the second clamping arm and wherein the other end of the pair of suspending arms are pivotably connected together.

21. An iron roughneck comprising:

an upper wrenching unit;

a lower wrenching unit; and the drillpipe spinner of claim 14.

22. The drillpipe spinner of claim 14, wherein the pin extends through a socket in the clamping arm.

23. The drillpipe spinner of claim 22, wherein the pin is held in the socket by one or more end caps.

24. The drillpipe spinner of claim 14, wherein each drive roller is rotated by an upper motor and a lower motor.

25. The drillpipe spinner of claim 24, wherein the rollers are synchronized by hydraulically connecting the upper motors in series and hydraulically connecting the lower motors in parallel.

26. The drillpipe spinner of claim 24, wherein the rollers are synchronized by hydraulically connecting the upper motors in parallel and hydraulically connecting the lower motors in series.

27. The drillpipe spinner of claim 14, wherein the one or more motors comprises a hydraulic motor.

28. A method of replacing the drive rollers and hydraulic drive motors of a drillpipe spinner comprising:

providing a drillpipe spinner, the spinner comprising a pair of clamping arms pivotably connected together at one end;

a roller bracket attached to the other end of each arm by a pin member, each roller bracket includes a pair of drive roller assemblies;

each driver roller assembly comprising one or more drive rollers, with each roller rotated by one or more hydraulic motors;

pulling only the pin member for a roller bracket to be replaced;

removing the roller bracket; and connecting a new roller bracket to the clamping arm.

29. The method of claim 28 further comprises connecting a new roller bracket on the clamping arm by reinserting the pin member.

30. The method of claim 28 wherein the drillpipe spinner is located on the rig floor of a drilling rig, further comprising replacing the old roller bracket on the rig floor.

31. A method of replacing the drive rollers and hydraulic drive motors of a drillpipe spinner comprising:

providing a drillpipe spinner, the spinner comprising a pair of clamping arms pivotably connected together at one end;

a roller bracket attached to the other end of each arm, each roller bracket having a pair of drive rollers assemblies;

each driver roller assembly comprising one or more drive rollers, with each roller rotated by one or more hydraulic motors;

a means for connecting a roller bracket to each clamping arm;

disconnecting only the means for connecting a roller bracket to a clamping arm for the roller bracket to be replaced;

removing the roller bracket; and connecting a new roller bracket to the clamping arm.

* * * * *

UNITED STATES PATENT AND TRADEMARK OFFICE

CERTIFICATE OF CORRECTION

PATENT NO. : 7,000,502 B2
DATED : February 21, 2006
INVENTOR(S) : Jaroslav Belik It is certified that error appears in the above-identified patent and that said Letters Patent is hereby corrected as shown below:

Title page,
Item [73], Assignee, "National-Oilwell" should read -- National-Oilwell, L.P. --.

Signed and Sealed this

Ninth Day of May, 2006

JON W. DUDAS
*Director of the United States Patent and Trademark Office*